US009678458B2

(12) United States Patent
Kase et al.

(10) Patent No.: US 9,678,458 B2
(45) Date of Patent: Jun. 13, 2017

(54) REMANUFACTURING METHOD OF DEVELOPER ACCOMMODATING UNIT

(71) Applicant: CANON KABUSHIKI KAISHA, Tokyo (JP)

(72) Inventors: Takashi Kase, Tokyo (JP); Kouki Yano, Kawasaki (JP); Yuta Isobe, Kawasaki (JP); Takahiro Ikeda, Oyama (JP); Yusuke Usui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/240,842

(22) Filed: Aug. 18, 2016

(65) Prior Publication Data

US 2016/0357128 A1 Dec. 8, 2016

Related U.S. Application Data

(63) Continuation of application No. 14/919,963, filed on Oct. 22, 2015, now Pat. No. 9,465,321.

(30) Foreign Application Priority Data

Oct. 27, 2014 (JP) ..... 2014-218517

(51) Int. Cl.
*G03G 15/08* (2006.01)

(52) U.S. Cl.
CPC ..... *G03G 15/0894* (2013.01); *G03G 15/0874* (2013.01)

(58) Field of Classification Search
CPC ..... G03G 15/0874; G03G 15/0894; G03G 21/181; G03G 2215/00995; G03G 2215/0682
See application file for complete search history.

(56) References Cited

U.S. PATENT DOCUMENTS 5,412,364 A 5/1995 Iguchi et al.
6,009,289 A * 12/1999 Sekine ..... G03G 21/12 399/113
2001/0021325 A1* 9/2001 Katsuyama ..... G03G 15/0874 399/258
2003/0123900 A1* 7/2003 Higeta ..... G03G 21/181 399/109
2003/0235436 A1* 12/2003 Kasahara ..... G03G 15/095 399/258
2005/0226655 A1* 10/2005 Katsuyama ..... G03G 15/0874 399/258

* cited by examiner

*Primary Examiner* — Francis Gray
(74) *Attorney, Agent, or Firm* — Canon U.S.A. Inc., IP Division

(57) ABSTRACT

Provided is a remanufacturing method of a developer accommodating unit including a frame member configured to accommodate a flexible container for accommodating developer. The remanufacturing method includes taking out the flexible container from the inside of the frame member, and refilling the developer into the flexible container.

38 Claims, 18 Drawing Sheets

REMANUFACTURING METHOD OF DEVELOPER ACCOMMODATING UNIT

CROSS-REFERENCE TO RELATED APPLICATIONS

This application is a continuation of U.S. patent application Ser. No. 14/919,963 filed Oct. 22, 2015, which claims the benefit of Japanese Patent Application No. 2014-218517, filed Oct. 27, 2014, all of which are hereby incorporated by reference herein in their entirety.

BACKGROUND OF THE INVENTION

Field of the Invention

The present invention relates to a remanufacturing method of a developer accommodating unit for refilling developer.

An image forming apparatus forms an image on a recording medium using an electrophotographic image forming process. Examples of image forming apparatuses include electrophotographic copying machines, electrophotographic printers (for example, laser beam printers and light emitting diode (LED) printers), facsimile apparatuses, and word processors.

A developing device includes developer, and a developing roller as a developer bearing member for developing an electrostatic image formed on a photosensitive drum as an image bearing member. The developing device is detachably attached to an image forming apparatus or a photosensitive drum unit including a photosensitive drum.

A cartridge (process cartridge) integrally includes a photosensitive drum and a developing roller, and is detachably attached to an image forming apparatus.

Description of the Related Art

Japanese Patent No. 3320403 discloses a remanufacturing method of a cartridge having a developing device, more specifically, a remanufacturing method of a cartridge for refilling, using a funnel, toner into a storage container for storing toner, after removing a developing roller and a developing blade.

SUMMARY OF THE INVENTION

The present invention is directed to a remanufacturing method of a developer accommodating unit including a flexible container.

According to an aspect of the present invention, a remanufacturing method of a developer accommodating unit includes taking out a flexible container from the inside of a frame member, and refilling developer into the frame member.

Further features of the present invention will become apparent from the following description of embodiments with reference to the attached drawings.

DESCRIPTION OF THE EMBODIMENTS

Figure 1:
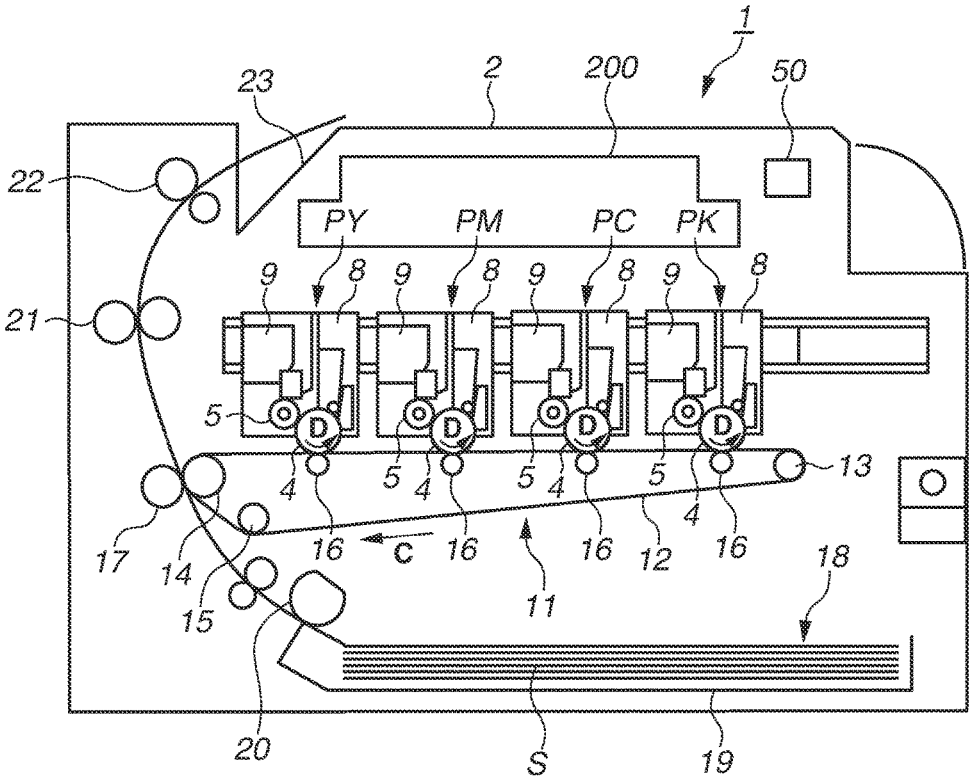
FIG. 1 is a sectional view illustrating an image forming apparatus.

Embodiments of the present invention will be described in detail below with reference to the accompanying drawings. However, sizes, materials, shapes, and relative positions of elements described in the embodiments are not limited thereto, and can be appropriately modified depending on the configuration of an apparatus according to the present invention and other various conditions. Unless otherwise specifically described, the scope of the present invention is not limited to the embodiments described below. Elements in subsequent embodiments that are identical to those in preceding embodiments are assigned the same reference numerals, and descriptions in the preceding embodiments will be incorporated by reference.

In the following description, a developer accommodating unit includes at least a frame member and a flexible container. A developing device includes at least a developer bearing member. Further, a process cartridge includes at least an image bearing member. In the embodiments, a developer accommodating unit has the same concept as a developing device. In the embodiments, a developing unit may be independently configured as a developing device.

First Embodiment

FIG. 1 is a sectional view illustrating an image forming apparatus 1. The image forming apparatus 1 performs full color image formation, and is provided with an apparatus body 2. Inside the apparatus body 2, four cartridges P are detachably attached. In the following descriptions of the image forming apparatus 1, the front surface is on the right side, the rear surface is on the left side, the drive side is on the rear side, and the non-drive side is on the front side, as illustrated in FIG. 1. The cartridges P attached to the apparatus body 2 are the following four cartridges: a first cartridge PY, a second cartridge PM, a third cartridge PC, and a fourth cartridge PK. These cartridges P are disposed in a horizontal direction.

These cartridges P have an approximately similar configuration expect for different toner colors. The first cartridge PY accommodates yellow developer, the second cartridge PM accommodates magenta developer, the third cartridge PC accommodates cyan developer, and the fourth cartridge PK accommodates black developer. The image forming apparatus 1 performs color image formation on a recording material S. The image forming apparatus 1 is a cartridge type image forming apparatus in which the cartridges P are detachably attached to the apparatus body 2 and a color image is formed on the recording material S.

A mechanism inside the cartridge P is driven by a rotational driving force received from a drive output unit (not illustrated) of the apparatus body 2. Internal devices in the cartridge P is supplied with bias voltages (a charging bias voltage, a developing bias voltage, etc.) from the apparatus body 2.

An exposure device 200 is disposed above the plurality of cartridges P. The exposure device 200 is a laser scanner unit for irradiating a photosensitive drum 4 with laser light LS based on information transmitted from a controller 50 in the apparatus body 2. This laser light LS passes through an exposure window portion 10 (refer to FIG. 2) inside the cartridge P, and the surface of the photosensitive drum 4 is exposed to the laser light LS to be scanned.

An intermediate transfer belt unit 11 is disposed below the plurality of cartridges P. The intermediate transfer belt unit 11 includes a transfer belt 12, and a drive roller 13 and tension rollers 14 and 15 for stretching the transfer belt 12. The transfer belt 12 is made of a flexible material.

The bottom surface of the photosensitive drum 4 inside the cartridge P contacts the upper surface of the transfer belt 12. The relevant contact portion is a primary transfer portion. Inside the transfer belt 12, primary transfer rollers 16 are disposed to surface respective photosensitive drums 4. A secondary transfer roller 17 is disposed at a position facing the tension roller 14 via the transfer belt 12. The contact portion between the secondary transfer roller 17 and the transfer belt 12 is a secondary transfer portion.

A feed unit 18 is disposed below the intermediate transfer belt unit 11. The feed unit 18 includes a tray 19 on which recording materials S are stacked, and a feed roller 20. A fixing unit 21 and a discharge unit 22 are disposed at the upper left position of the cartridge P. A discharge tray 23 is formed on the upper surface of the apparatus body 2. The recording material S is fixed by the fixing unit 21 and then discharged onto the discharge tray 23.

Figure 2:
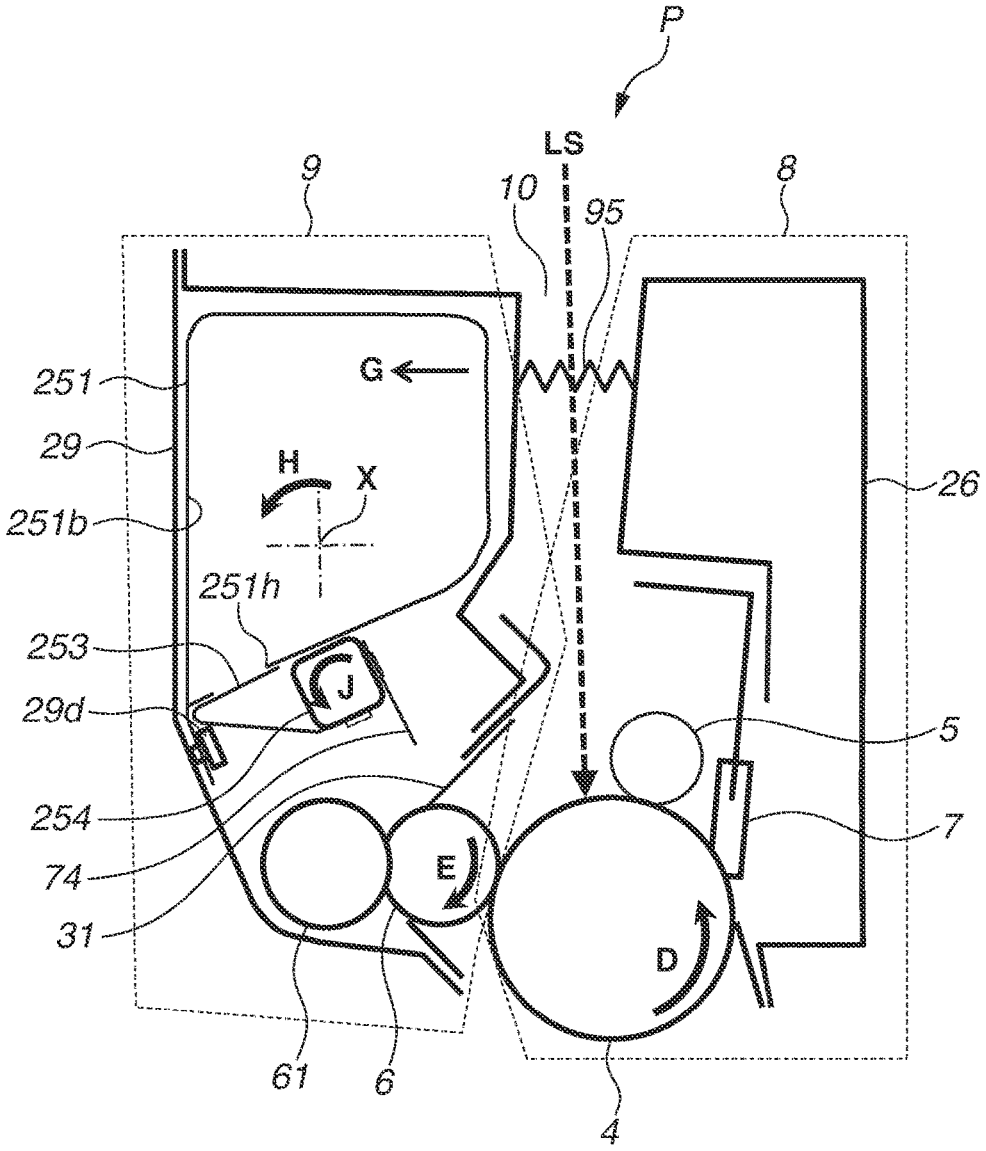
FIG. 2 is a sectional view illustrating a cartridge.

FIG. 2 is a sectional view illustrating the cartridge P. The cartridge P includes a photosensitive unit 8 and a developing unit 9 as a "developer accommodating unit". The photosensitive unit 8 includes the photosensitive drum 4 as an "image bearing member", a charging roller 5, and a cleaning member 7. The charging roller 5 uniformly charges the surface of the photosensitive drum 4. The cleaning member 7 is a blade for removing residual toner that has been developed on the surface of the photosensitive drum 4, but has not been transferred onto the primary transfer roller 16.

The developing unit 9 includes a developing roller 6 as a "developer bearing member", a supply roller 61, and an agitating member 74. The developing roller 6 develops an electrostatic image on the surface of the photosensitive drum 4 using toner. The supply roller 61 supplies developer to the developing roller 6. The agitating member 74 agitates the developer inside the developing unit 9.

Operations of the image forming apparatus 1 will be described below with reference to above-described FIGS. 1 and 2. The surface of the photosensitive drum 4 is uniformly charged by the charging roller 5 and then is exposed to light by the exposure device 200, so that an electrostatic image is formed on the surface of the photosensitive drum 4. When the electrostatic image is developed by the developing unit 9 using the developer, a developer image is formed. The developer image on the surface of the photosensitive drum 4 is transferred onto the transfer belt 12 rotating in a forward direction (the direction indicated by an arrow C illustrated in FIG. 1) of the rotational direction of the photosensitive drum 4. Yellow, magenta, cyan, and black developer images are primarily transferred sequentially from the respective photosensitive drums 4 of the first to the fourth cartridges P onto the transfer belt 12 to be superimposed upon one another.

Meanwhile, the recording materials S stacked on the tray 19 are separated and fed one by one at a predetermined control timing. Each of the recording materials S is conveyed to the secondary transfer portion between the secondary transfer roller 17 and the transfer belt 12. At the secondary transfer portion, the developer image on the surface of the transfer belt 12 is secondarily transferred onto the recording material S.

A frame member 29 of the developing unit 9 accommodates (stores) a flexible container 251. The flexible container 251 includes an accommodating portion **251*b* for accommodating (storing) developer T, and openings 251*h* (refer to FIGS. 6A and 6B) for discharging the developer T. The developing unit 9 includes a sealing member 253 for sealing the openings 251*h* and exposing the openings 251*h* when being moved, and an unsealing member 254, to which the sealing member 253 is attached, and which moves to unseal the openings 251*h*. In other words, the developing unit 9 refers to a unit including at least the flexible container 251, the sealing member 253, and the unsealing member 254 inside the frame member 29**.

Figure 3:
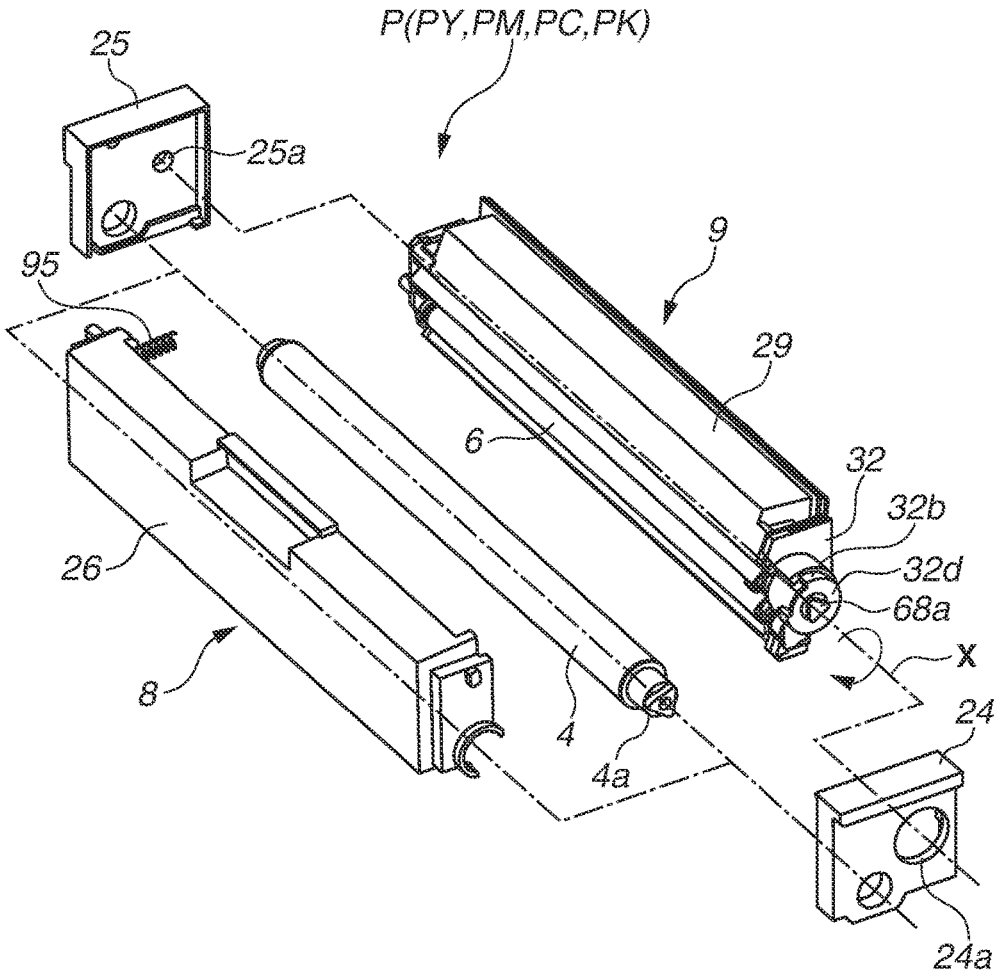
FIG. 3 is a perspective view illustrating a cartridge viewed from a drive side.
Figure 4:
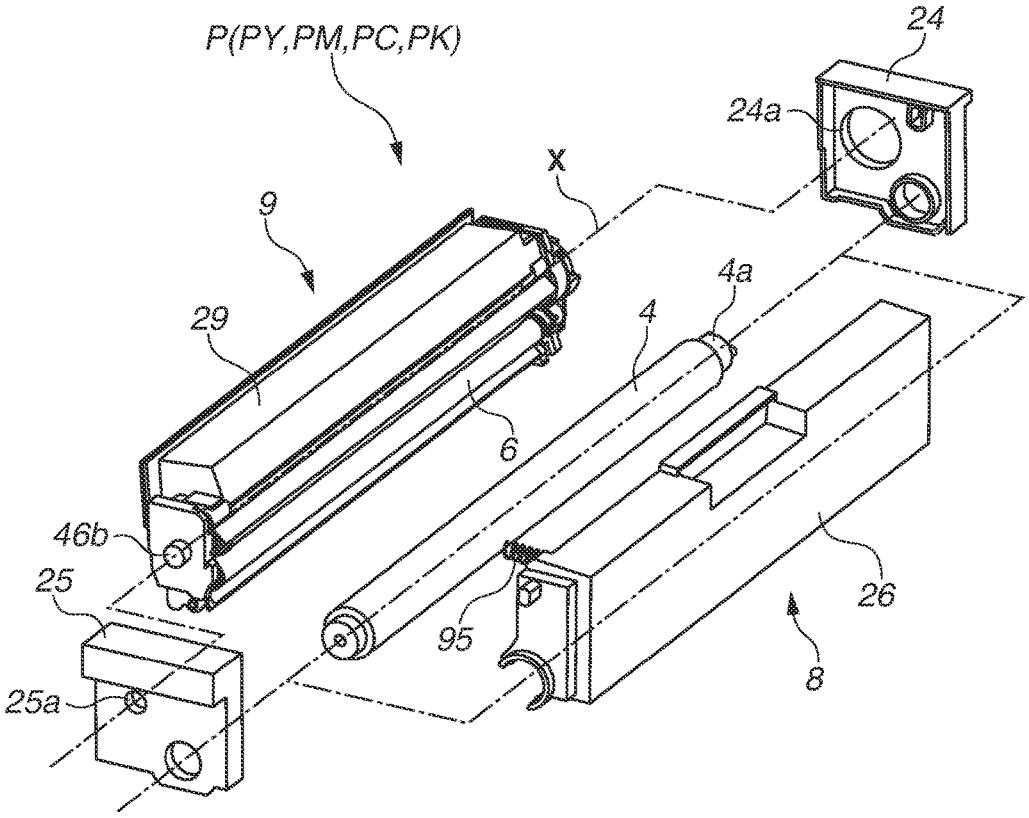
FIG. 4 is a perspective view illustrating a cartridge viewed from a non-drive side.

FIG. 3 is a perspective view illustrating the cartridge P viewed from the drive side. FIG. 4 is a perspective view illustrating the cartridge P viewed from the non-drive side. As illustrated in FIGS. 3 and 4, the photosensitive unit 8 and the developing unit 9 are integrally formed by covers 24 and 25. Therefore, the photosensitive unit 8 includes the photosensitive drum 4, the charging roller 5, the cleaning member 7, a cleaning container 26, and the covers 24 and 25. The photosensitive drum 4 is rotatably supported on the cleaning container 26 by the covers 24 and 25.

One end side of the photosensitive drum 4 in the longitudinal direction is provided with a coupling member **4*a* for transmitting a driving force to the photosensitive drum 4. When the coupling member 4*a* is engaged with a drum drive output unit of the apparatus body 2, the driving force of the drive motor (not illustrated) of the apparatus body 2 is transmitted to the photosensitive drum 4. The charging roller 5 is supported by the cleaning container 26 so that the charging roller 5 can be rotatably driven with being in contact with the photosensitive drum 4. The cleaning member 7 is supported by the cleaning container 26 so that the cleaning member 7 contacts the circumferential surface of the photosensitive drum 4** at a predetermined pressure.

Residual developer removed from the circumferential surface of the photosensitive drum 4 by the cleaning member 7 is stored in the cleaning container 26. Holes 24*a* and 25*a* for rotatably supporting the developing unit 9 are formed on the covers 24 and 25, respectively.

Figure 5:
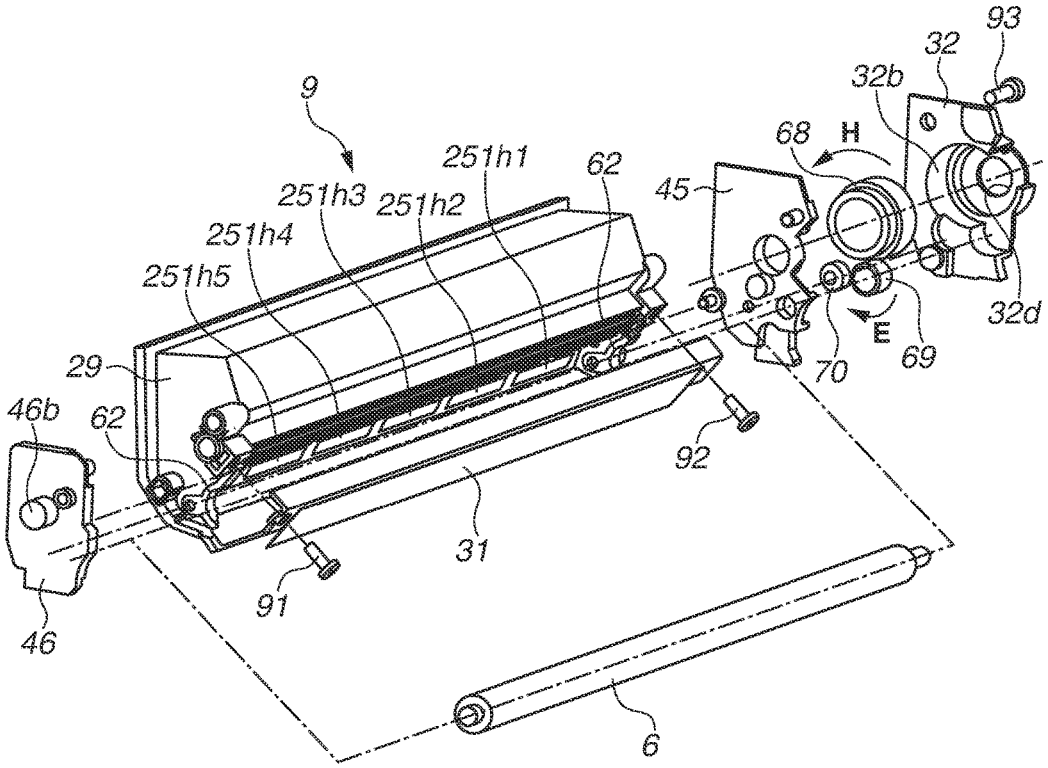
FIG. 5 is an exploded perspective view illustrating a developing unit.
Figure 6A:
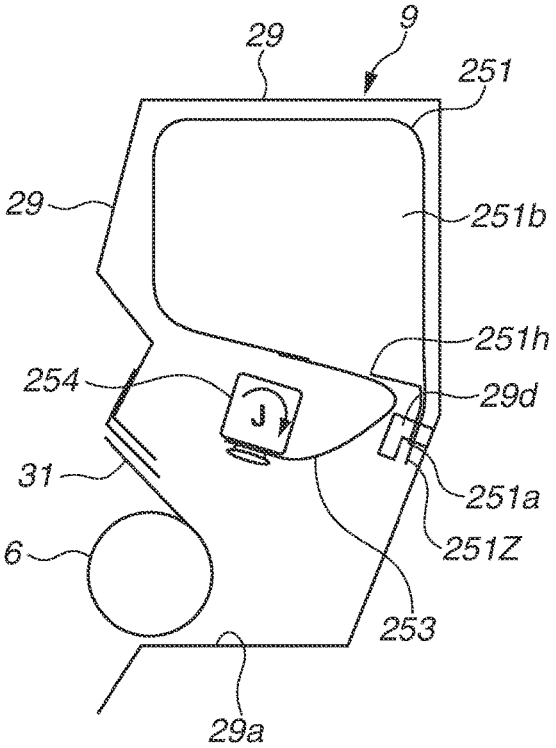
FIG. 6A is a sectional view illustrating the developing unit.
Figure 6B:
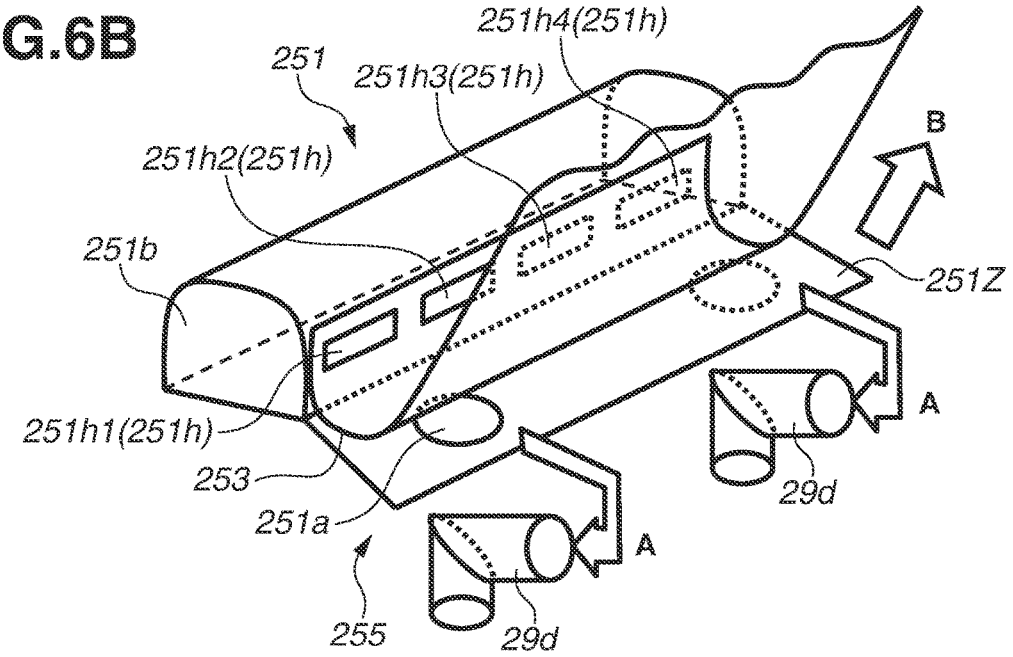
FIG. 6B is a perspective view illustrating a flexible container.

FIG. 5 is an exploded perspective view illustrating the developing unit 9. FIG. 6A is a sectional view illustrating the developing unit 9. FIG. 6B is a perspective view illustrating the flexible container 251. The flexible container 251 illustrated in FIGS. 6A and 6B is stored in the developing unit 9 illustrated in FIG. 5. As illustrated in FIG. 5, the developing unit 9 includes the developing roller 6, a developing blade 31, the frame member 29, bearings 45 and 46, and a cover 32.

The frame member 29 is provided with a projection 29*d* as a "fixing member" for fixing a fixed member 251Z of the flexible container 251. The projection 29*d* is a bent-shaped portion to be inserted into a hole 251*a*. The flexible container 251 includes the fixed member 251Z on which the hole 251*a* to be fixed to the frame member 29 is formed, the accommodating portion 251*b* for accommodating (storing) the developer, and the openings 251*h* (251*h*1 to 251*h*4) for discharging the developer (refer to FIG. 6).

The hole 251*a* of the fixed member 251Z is a hole different from the openings 251*h*. When the hole 251*a* is hooked on the projection 29*d*, the flexible container 251 is fixed to the frame member 29. When the hole 251*a* is unhooked from the projection 29*d*, the flexible container 251 becomes separable from the frame member 29.

When the cartridge P is new, since the openings 251*h* (251*h*1 to 251*h*4) are covered by the sealing member 253 detachably welded to the flexible container 251, the developer is sealed inside the flexible container 251.

The sealing member 253 is coupled to the unsealing member 254. The unsealing member 254 is supported so as to be rotatable in the direction indicated by an arrow J by receiving a driving force from the apparatus body 2.

When the new cartridge P is used, the cartridge P is attached to the apparatus body 2. Then, the unsealing member 254 receives a driving force from the apparatus body 2 to rotate.

At this timing, the sealing member 253 is detached from the flexible container 251 and is rolled up by the unsealing member 254. Thus, the openings 251*h* (251*h*1 to 251*h*4) of the flexible container 251 are exposed, enabling the developer in the flexible container 251 to be discharged into the frame member 29.

Figure 15A:
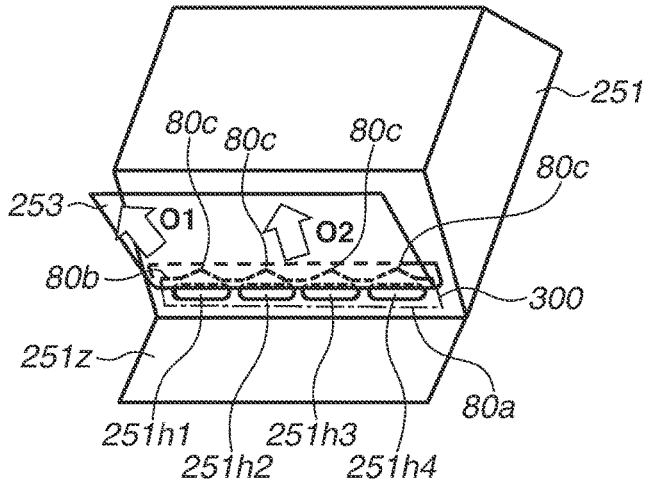
FIGS. 15A, 15B, and 15C are perspective views illustrating a process for detaching the sealing member from the flexible container.
Figure 15B:
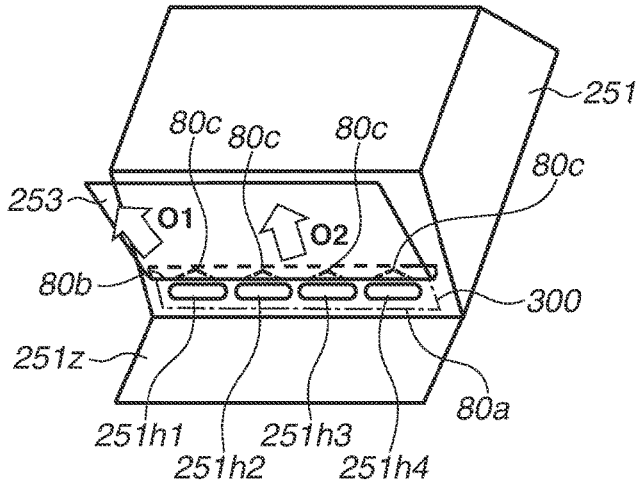
Figure 15C:
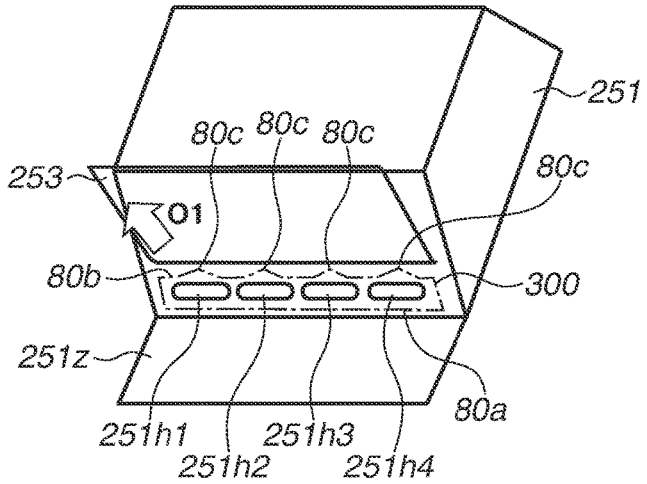

FIGS. 15A, 15B, and 15C are perspective views illustrating a process for detaching the sealing member 253 from the flexible container 251. When the unsealing member 254 rotates, the sealing member 253 is detached from an attachment and detachment area 300 around the openings 251*h*1 to 251*h*4 of the accommodating portion 251*b* of the flexible container 251. Although four openings 251*h* are illustrated in FIGS. 15A, 15B, and 15C, there are six openings 251*h* in the present embodiment.

The attachment and detachment area 300 has two different portions on the downstream side in the detachment direction: parallel portions 80*b* parallel to the axis direction of the developing roller 6, and mountain-shaped portions 80*c* having a mountain shape toward the downstream side in the detachment direction. The attachment and detachment area 300 further includes a detachment start portion 80*a* parallel to the axis direction of the developing roller 6, at the upstream side in the detachment direction. The sealing member 253 is pulled in the direction indicated by an arrow O1 and the direction indicated by an arrow O2 to be detached in states illustrated in FIGS. 15A, 15B, and 15C in this order.

A method for fixing the flexible container 251 to the frame member 29 will be described below. As illustrated in FIGS. 6A and 6B, the hole 251*a* of the flexible container 251 and the projection 29*d* of the frame member 29 are disposed on the side of an opening 29*a* of the frame member 29 rather than on the side of the accommodating portion 251*b* of the flexible container 251. The projection 29*d* is formed in an L-shape. When the user moves the hole 251*a* in the direction indicated by an arrow A toward the L-shaped projection 29*d* to hook the hole 251*a* on the projection 29*d*, the flexible container 251 is fixed. When detaching the sealing member 253, a force is applied to the flexible container 251 in the direction indicated by an arrow B illustrated in FIG. 6B. Therefore, fixing the flexible container 251 in this way prevents the hole 251*a* from being unhooked when detaching the sealing member 253.

The developing blade 31 for regulating the layer thickness of the developer on the circumferential surface of the developing roller 6 is fixed to the frame member 29 (refer to FIG. 5). The bearings 45 and 46 illustrated in FIG. 5 are fixed at both ends of the frame member 29 in the longitudinal direction. Gears 70, 69, and 68 are disposed on the drive side end. The shaft of the supply roller 61 is fitted into the gear 70. The shaft of the developing roller 6 is fitted into the gear 69. The shaft of the agitating member 74 (FIG. 2) is fitted into the gear 68.

The gear 69 is set to rotate when the gear 68 rotates. The bearing 45 is provided with the gears 68, 69, and 70. The cover 32 is fixed to the outside of the gears 68, 69, and 70. End seals 62 are disposed at both ends of the shaft of the supply roller 61 to seal between the supply roller 61 and the frame member 29.

As illustrated in FIG. 5, the cover 32 is provided with a cylindrical portion 32*b*. A drive transmission portion 68*a* of the gear 68 is exposed through an opening 32*d* inside the cylindrical portion 32*b*. When the cartridge P is attached to the apparatus body 2, the drive transmission portion 68*a* of the gear 68 is engaged with an apparatus body drive transmission member (not illustrated), so that a driving force from a drive motor (not illustrated) provided in the apparatus body 2 is transmitted. The driving force input from the apparatus body 2 to the gear 68 is transmitted to the developing roller 6 via the gear 69.

[Photosensitive Unit and Developing Unit Assembling Process]

As illustrated in FIGS. 3 and 4, when assembling the developing unit 9 and the photosensitive unit 8, the outer diameter portion of the cylindrical portion 32*b* of the cover 32 is fitted into the hole 24*a* of the cover 24 on one end side. Then, a protruding portion 46*b* protruding from the bearing 46 is fitted into the hole 25*a* of the cover 25 on the other end side. Thus, the developing unit 9 is supported so as to be rotatable with respect to the photosensitive unit 8. The developing unit 9 is rotatable around an axis line connecting the hole 24*a* of the cover 24 and the hole 25*a* of the cover 25. The rotation center of the developing unit 9 is referred to as a rotation center X (refer to FIG. 2).

As illustrated in FIG. 2, the developing unit 9 is urged by a pressure spring 95 as an elastic member so that the developing roller 6 contacts the photosensitive drum 4 around the rotation center X. More specifically, the developing unit 9 is pressed in the direction indicated by an arrow G illustrated in FIG. 2 by an urging force of the pressure spring 95 so that a moment in the direction indicated by an arrow H acts around the rotation center X.

Referring to FIG. 5, the gear 68 receives a rotational driving force in the direction indicated by the arrow H (refer to FIG. 2) from an apparatus body drive transmission member (not illustrated) provided on the apparatus body 2. The gear 69 engaged with the gear 68 thereby rotates in the direction indicated by an arrow E. Likewise, the developing roller 6 thereby rotates in the direction indicated by the arrow E. When a driving force required for rotating the developing roller 6 is input to the gear 68, a rotational moment in the direction indicated by the arrow H arises in the developing unit 9.

A pressing force of the above-described pressure spring 95 and a rotational driving force from the apparatus body 2 cause the developing unit 9 to receive a moment in the direction indicated by the arrow H around the rotation center X. Then, the developing roller 6 contacts the photosensitive drum 4 at a predetermined pressure. Although, in the present embodiment, two forces, i.e., the pressing force by the pressure spring 95 and the rotational driving force from the apparatus body 2 are used to press the developing roller 6 against the photosensitive drum 4, only either one force may be used for the relevant purpose.

With the cartridge P being attached to the inside of the apparatus body 2, image formation is performed while consuming the developer inside the developing unit 9. The remanufacturing method of the cartridge P of refilling the developer into the developing unit 9 after consuming the developer inside the developing unit 9 will be sequentially described below.

[Unit Separation Process]

The remanufacturing method of the developing unit 9 will be described below. A unit separation process for separating the photosensitive unit 8 and the developing unit 9 of the cartridge P will be described below. As illustrated in FIG. 3, when the covers 24 and 25 are removed from the cleaning container 26, the developing unit 9 and the photosensitive unit 8 can be separated. As described above, since the covers 24 and 25 and the cleaning container 26 rotatably support the photosensitive drum 4, the above-described unit separation process enables the separation of the photosensitive drum 4 from the photosensitive unit 8.

[Developing Unit Disassembling Process]

A process for disassembling the developing unit 9 will be described below with reference to FIG. 5. First of all, the cover 32 provided at the drive side end of the developing unit 9 is separated from the frame member 29. When the cover 32 is fixed to the bearing 45 and the frame member 29 with a screw 93, the screw 93 is removed and then the cover 32 is separated from the developing unit 9.

Then, on the drive side of the developing unit 9, the gears 68, 69, and 70 disposed inside the cover 32 in the longitudinal direction are separated from the developing unit 9. The gear 68 is slidably supported by the cover 32 and the bearing 45, and the gear 69 is fitted into an end of the shaft of the developing roller 6. The gear 70 is fitted into the shaft of the supply roller 61. Therefore, the gears 68, 69, and 70, the developing roller 6, and the supply roller 61 can be easily separated from the developing unit 9.

Then, the bearings 45 and 46 and the developing roller 6 are separated from the developing unit 9. When the bearing 45 is fixed to the frame member 29 with a screw, the screw is removed and then the bearing 45 is separated from the frame member 29. In the present embodiment, the bearing 45 and the cover 32 are fixed together to the frame member 29 with the screw 93. Since the screw 93 has been removed when the cover 32 is separated from the frame member 29, the bearing 45 can be easily separated from the frame member 29. Likewise, when the bearing 46 is fixed to the frame member 29 with a screw, the bearing 46 can be separated from the frame member 29 after the screw is removed.

As described above, the developing roller 6 is slidably supported on the frame member 29 by the bearings 45 and 46. Therefore, in a state where the bearings 45 and 46 are separated from the frame member 29, the developing roller 6 can be easily separated from the frame member 29. Although, in the above descriptions, a process for separating both the bearings 45 and 46 from the frame member 29 is performed to separate the developing roller 6 from the frame member 29, the method is not limited thereto. For example, after only the bearing 46 is separated from the frame member 29, the developing roller 6 may be pulled out toward the non-drive side to separate the developing roller 6 from the frame member 29.

Then, the developing blade 31 is separated from the frame member 29. When the developing blade 31 is fixed to the frame member 29 with screw 91 and 92, the screws 91 and 92 are removed and then the developing blade 31 is separated from the frame member 29.

[Flexible Container Taking-Out Process]

A process for taking out the flexible container 251 from the inside of the frame member 29 will be described below. As illustrated in FIGS. 6A and 6B, when the flexible container 251 is pulled in the direction opposite to the direction indicated by the arrow A illustrated in FIG. 6B, the hole 251*a* of the flexible container 251 can be easily unhooked from the L-shaped projection 29*d*. In this case, since the L-shaped projection 29*d* is disposed on the side of the opening 29*a* rather than on the side of the flexible container 251, the user can easily perform this unhooking procedure. After unhooking the fixing portion of the flexible container 251 from the L-shaped projection 29*d* in this way, the user takes out the flexible container 251 from the inside of the frame member 29 through the opening 29*a* (taking-out process).

(Developer Refilling Process)

Figure 7:
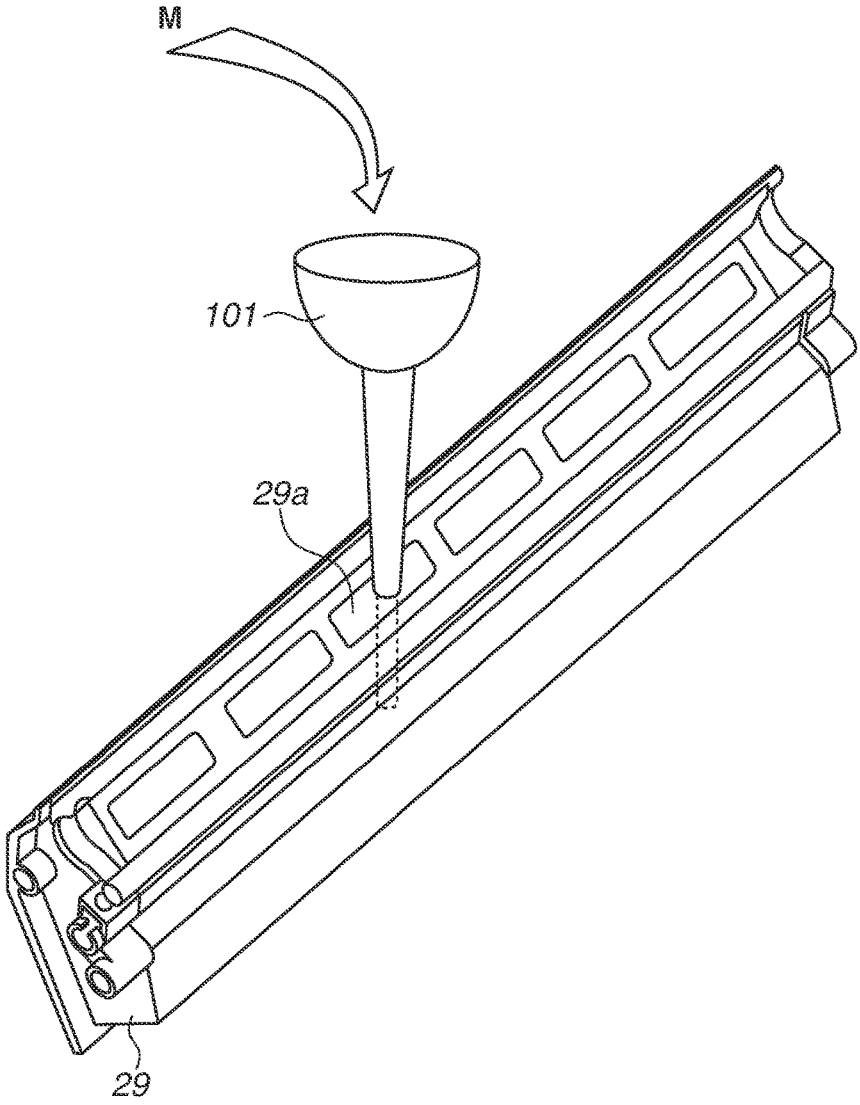
FIG. 7 is a perspective view illustrating a frame member after developer is refilled into the frame member.

FIG. 7 is a perspective view illustrating the frame member 29 after the developer is refilled into the frame member 29. A refilling process for refilling the developer into the frame member 29 will be described below with reference to FIG. 7. In the refilling process, as illustrated in FIG. 7, the user injects the developer into a funnel 101 in the direction indicated by an arrow M. The injected developer T falls into the frame member 29 from the tip portion of the funnel 101, and is accumulated inside the frame member 29. Thus, the developer T is refilled into the frame member 29 (refilling process). Using a fixed-rate feeding device having an auger instead of the funnel 101 enables efficient injection of the developer T into the frame member 29.

Although, in the present embodiment, the funnel 101 is inserted into the opening 29*a* of the frame member 29 and the developer T is refilled, the method is not limited thereto. More specifically, the user may perform the above-described refilling process after forming a hole on the frame member 29 and then inserting the tip portion of the funnel 101 into the frame member 29.

[Developing Unit Assembling Process]

As described above, the developer is refilled into the frame member 29 and then the cartridge P is reassembled. The cartridge P can be reassembled by performing the above-described separation process in reverse order. The reassembling method of the developing unit 9 will be described below with reference to FIG. 5.

First of all, the supply roller 61 is fitted into the frame member 29. The gap between the shaft of the supply roller 61 and the frame member 29 is sealed by the end seals 62. The developing blade 31 is fixed to the frame member 29 with the screws 91 and 92. Then, the developing roller 6 is placed in the frame member 29, and the bearings 45 and 46 are attached to the frame member 29 from both ends in the longitudinal direction.

Then, the gear 68 is fitted into the bearing 45, the gear 69 is fitted into an end of the developing roller 6, and the gear 70 is fitted into an end of the supply roller 61. Then, the cover 32 is fixed to the outside of the frame member 29 or the bearing 45 in the longitudinal direction with the screw 93 so as to cover the gears 68 and 69. Upon completion of the above-described procedure, the assembling process of the developing unit 9 is completed.

[Unit Combining Process]

A unit combining process for combining the photosensitive unit 8 and the developing unit 9 will be described below with reference to FIG. 3. In this process, the cleaning container 26, the photosensitive drum 4, and the developing unit 9 are simultaneously sandwiched between the covers 24 and 25. To hold the developing unit 9 so as to be rotatable with respect to the photosensitive unit 8, the outer diameter portion of the cylindrical portion 32*b* of the cover 32 is fitted into the hole 24*a* of the cover 24. The protruding portion 46*b* protruding from the bearing 46 is fitted into the hole 25*a* of the cover 25.

Upon completion of the above-described procedure, the assembly of the cartridge P is completed as illustrated in FIG. 2. Note that the cartridge P that has undergone the above-described processes is in a state in which the flexible container 251 is removed from the cartridge P illustrated in FIG. 2. The above-described remanufacturing method of the cartridge P achieves a simplified remanufacturing method of the cartridge P.

Second Embodiment

Figure 8:
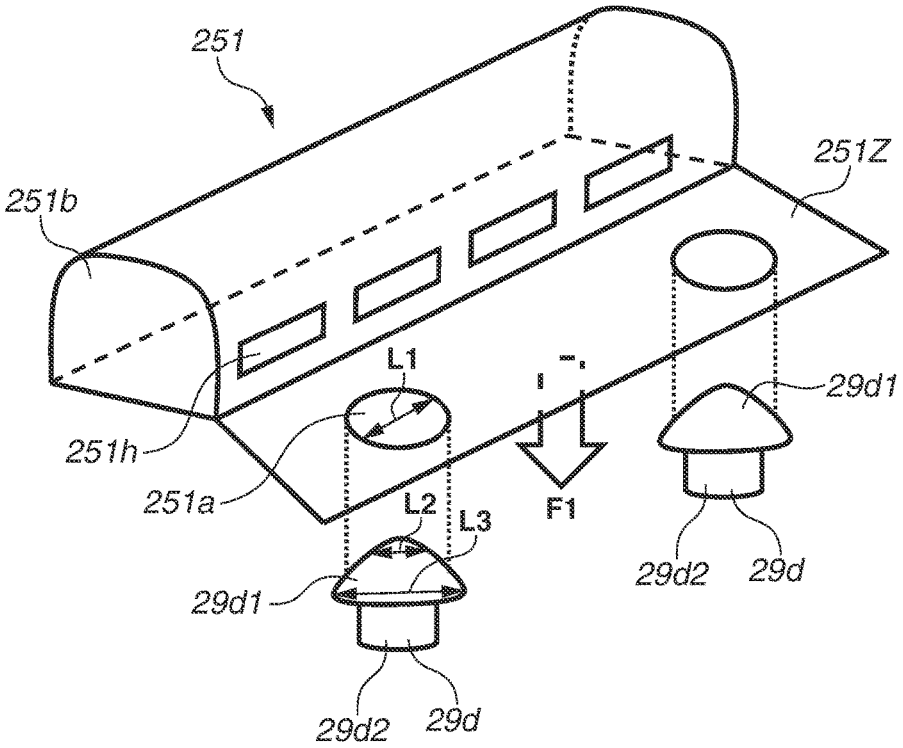
FIG. 8 is a perspective view schematically illustrating a process for fixing a flexible container according to a second embodiment.

FIG. 8 is a perspective view schematically illustrating a process for fixing the flexible container 251 according to the second embodiment. A method for fixing the flexible container 251 will be described below with reference to FIG. 8. In the present embodiment, the projection 29*d* is formed on the side of the opening 29*a* rather than on the side of the accommodating portion 251*b* of the flexible container 251.

The mushroom-shaped projection 29*d* as a "fixing member" is a projection having a conical head (or cylindrical head). The projection 29*d* has a large-diameter portion 29*d*1 with a diameter larger than the diameter of the hole 251*a* and a small-diameter portion 29*d*2 with a diameter equal to or smaller than the diameter of the hole 251*a*. When the large-diameter portion 29*d*1 is inserted into the hole 251*a*, the flexible container 251 is fixed to the frame member 29. The projection 29*d* is configured to be insertable into the hole 251*a*. When the hole 251*a* is moved in the direction indicated by an arrow F1 and then hooked on the mushroom-shaped projection 29*d*, the flexible container 251 is fixed. On the contrary, when the large-diameter portion 29*d*1 is unhooked from the hole 251*a*, the flexible container 251 becomes separable from the frame member 29.

In this case, the circumference of the hole 251*a* of the flexible container 251 is made of an elastic material. A diameter L1 of the hole 251*a* is set to be larger than a diameter L2 of the tip portion of the mushroom-shaped projection 29*d* and smaller than a diameter L3 of the largest portion. With this configuration, once the hole 251*a* is hooked on the projection 29*d*, they cannot be easily unhooked. A process for taking out the flexible container 251 from the inside of the frame member 29 will be described below.

Since the vicinity of the hole 251*a* of the flexible container 251 is made of an elastic material, pulling the flexible container 251 in the direction opposite to the direction indicated by the arrow F1 illustrated in FIG. 8 extends the hole 251*a*, making it easy to take out the flexible container 251. In this case, since the mushroom-shaped projection 29*d* is disposed on the side of the opening 29*a* of the frame member 29, the user can easily perform this unhooking procedure. After removing the fixed member 251Z of the flexible container 251 in this way, the user takes out the flexible container 251 from the frame member 29 through the opening 29*a*. The disassembling process of the cartridge P, the assembling process, and the refilling process are similar to those according to the first embodiment, and descriptions thereof will be omitted.

Third Embodiment

Figure 9:
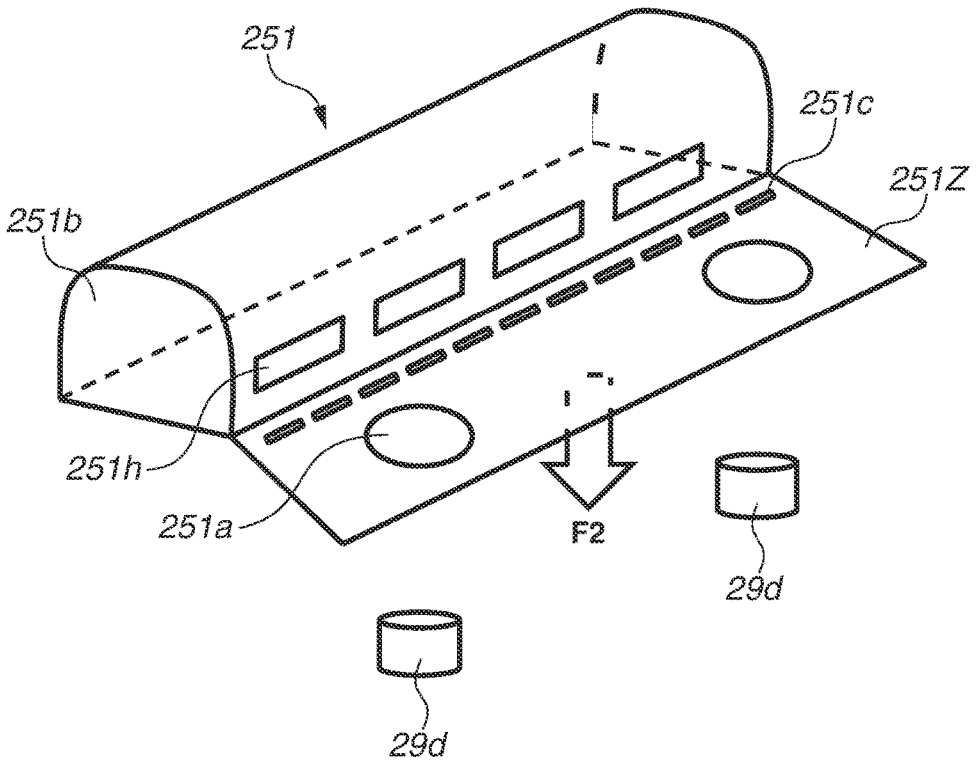
FIG. 9 is a perspective view illustrating a process for fixing a flexible container according to a third embodiment.

FIG. 9 is a perspective view illustrating a process for fixing the flexible container 251 according to the third embodiment. A method for fixing the flexible container 251 will be described below with reference to FIG. 9. As illustrated in FIG. 9, a perforation 251*c* is formed in the flexible container 251 at a portion of the fixed member 251Z between the accommodating portion 251*b* and the hole 251*a*. The strength of the perforation 251*c* is set so that the perforation 251*c* can sufficiently withstand the force applied when the sealing member 253 is detached. Other configurations of the flexible container 251 are similar to those according to the first embodiment, and descriptions thereof will be omitted.

A method for fixing the flexible container 251 according to the present embodiment will be described below. As illustrated in FIG. 9, the cylindrical projection 29*d* is formed on the side of the opening 29*a* of the frame member 29 rather than on the side of the accommodating portion 251*b* of the flexible container 251. After moving the hole 251*a* in the direction indicated by an arrow F2 to hook the hole 251*a* on the cylindrical projection 29*d*, the user applies heat and pressure to the cylindrical projection 29*d* to deform the cylindrical projection 29*d*, thereby fixing the flexible container 251 (thermal swaging method). As a method for fixing the flexible container 251, ultrasonic swaging, thermal welding, ultrasonic welding, welding using solvents or adhesives, and screws may be used in addition to thermal swaging.

A process for taking out the flexible container 251 from the inside of the frame member 29 will be described below. The perforation 251*c* is formed between the accommodating portion 251*b* and the hole 251*a* of the flexible container 251. Therefore, when the user pulls the flexible container 251 from the opening 29*a*, the user can cut off the fixed member 251Z at the perforation 251*c* of the flexible container 251 between the accommodating portion 251*b* and the hole

251*a*, separate the accommodating portion 251*b* of the flexible container 251 from the frame member 29 (separation process), and easily take out the flexible container 251.

The user performs such a separation process by cutting off at the perforation 251*c* before the taking-out process of the flexible container 251 and the developer refilling process. The disassembling process of the cartridge P, the assembling process, and the refilling process are similar to those according the first embodiment, and descriptions thereof will be omitted.

Fourth Embodiment

Figure 10:
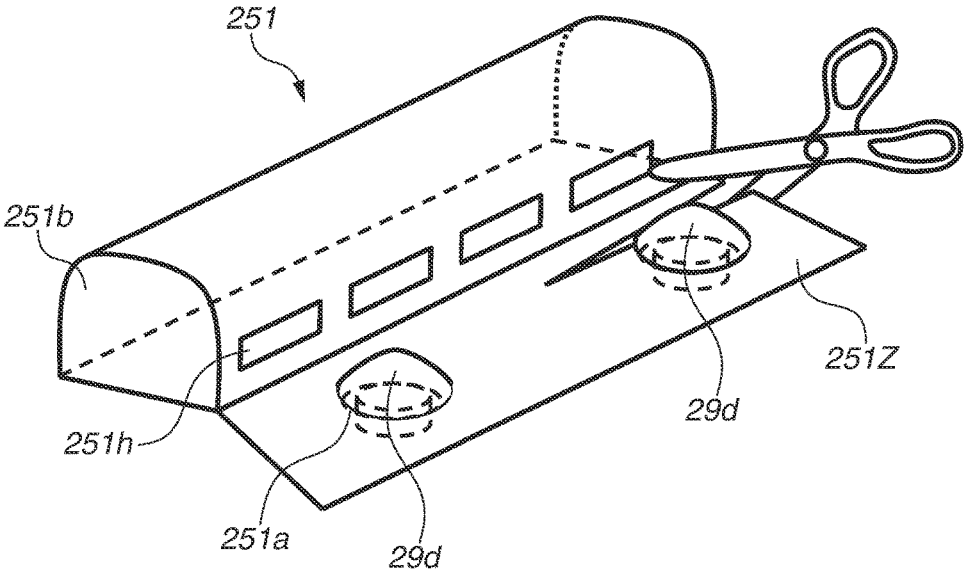
FIG. 10 is a perspective view illustrating a process for fixing a flexible container according to a fourth embodiment.

FIG. 10 is a perspective view illustrating a process for separating the flexible container 251 according to the fourth embodiment. The separation method of the flexible container 251 will be described below with reference to FIG. 10. As illustrated in FIG. 10, before the taking-out process of the flexible container 251 and the refilling process, the user first cuts off the fixed member 251Z between the accommodating portion 251*b* of the flexible container 251 and the hole 251*a*, using a cutter knife, scissors, etc. to separate the accommodating portion 251*b* from the frame member 29 (separation process). The projection 29*d* is inserted in the hole 251*a*.

Subsequently, the accommodating portion 251*b* can be easily taken out. The disassembling process of the cartridge P, the assembling process, and the refilling process are similar to those according to the first embodiment, and descriptions thereof will be omitted.

Fifth Embodiment

Figure 11A:
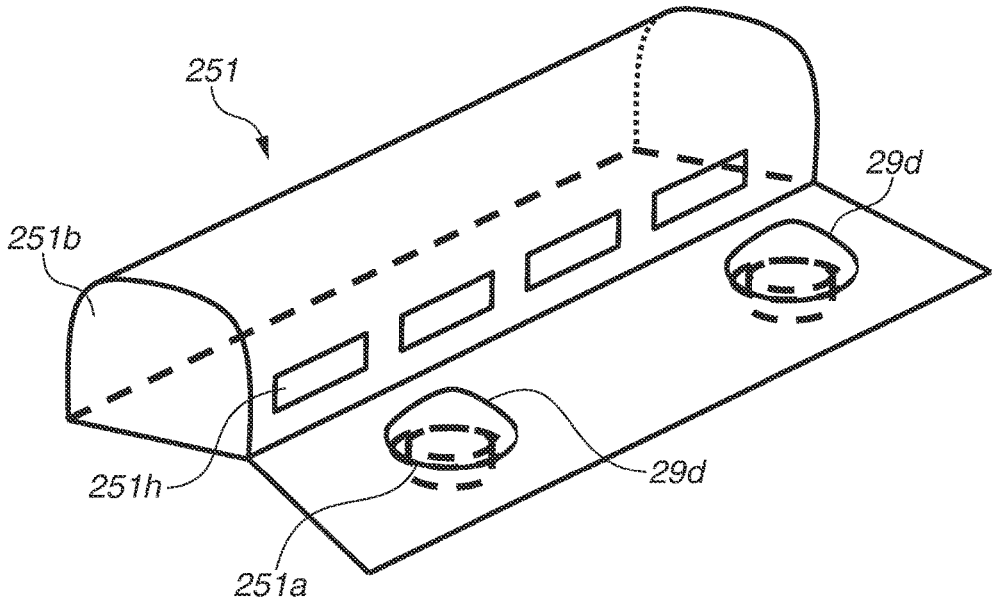
FIGS. 11A and 11B are perspective views illustrating a process for fixing a flexible container according to a fifth embodiment.
Figure 11B:
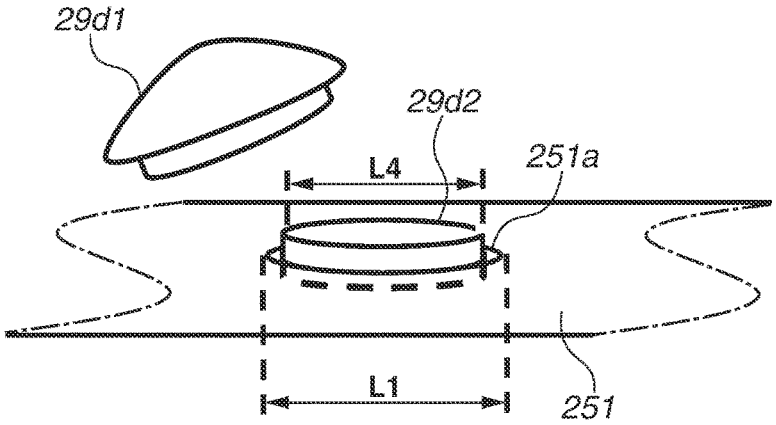

FIGS. 11A and 11B are perspective views illustrating a process for separating the flexible container 251 according to the fifth embodiment. The separation method of the flexible container 251 will be described below with reference to FIGS. 11A and 11B. As illustrated in FIG. 11A, the accommodating portion 251*b* is fixed by the mushroom-shaped projection 29*d*. The projection 29*d* has the large-diameter portion 29*d*1 with a diameter larger than the diameter of the hole 251*a* and the small-diameter portion 29*d*2 with a diameter equal to or smaller than the diameter of the hole 251*a*. The large-diameter portion 29*d*1 is inserted in the hole 251*a*.

When the large-diameter portion 29*d*1 is inserted into the hole 251*a*, the flexible container 251 is fixed to the frame member 29. When taking out the flexible container 251, before the taking-out process of the flexible container 251 and the refilling process, the user first cuts off the large-diameter portion 29*d*1 of the projection 29*d* using a nipper as illustrated in FIG. 11B to separate the flexible container 251 from the frame member 29 (separation process).

Then, the flexible container 251 can be easily removed since a diameter L4 of the small-diameter portion 29*d*2 of the projection 29*d* left uncut is smaller than a diameter L1 of the hole 251*a* of the flexible container 251. The disassembling process of the cartridge P, the assembling process, and the refilling process are similar to those according to the first embodiment, and descriptions thereof will be omitted.

Sixth Embodiment

Figure 12A:
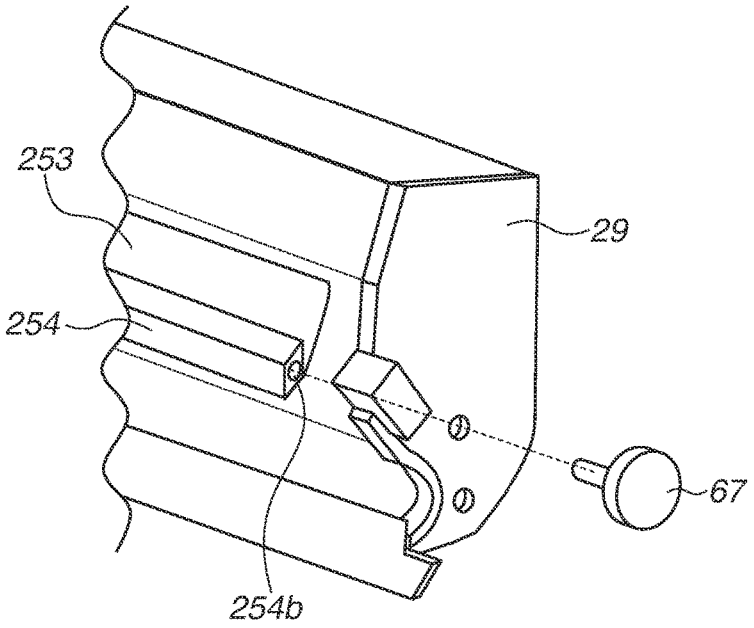
FIG. 12A is a perspective view illustrating a configuration of a frame member and an unsealing member according to a sixth embodiment.
Figure 12B:
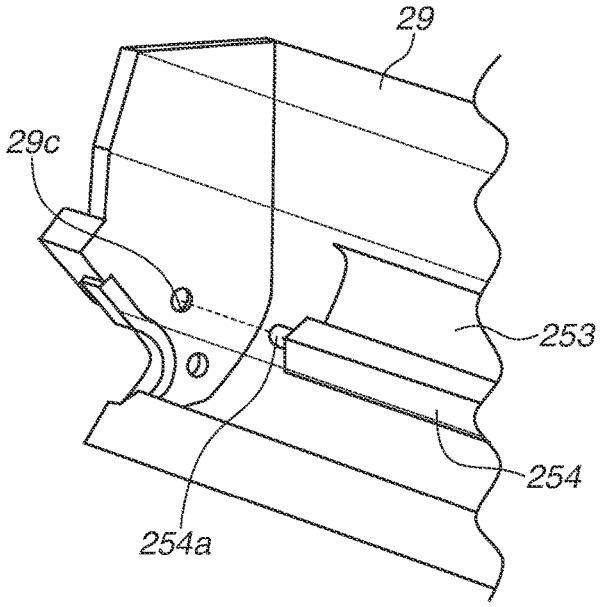
FIG. 12B is a perspective view illustrating a state where the unsealing member is removed from the frame member according to the sixth embodiment.

FIG. 12A is a perspective view illustrating a configuration of the frame member 29 and the unsealing member 254 according to the sixth embodiment. FIG. 12B is a perspective view illustrating a state where the unsealing member 254 is removed from the frame member 29. An unsealing gear 67 is fitted into the unsealing member 254 from the outside on the drive side of the frame member 29. On the non-drive side, a shaft 254*a* of the unsealing member 254 is fitted into a hole 29*c* formed inside the frame member 29. The unsealing member 254 is configured to receive a driving force from the apparatus body 2 to be rotatable in the direction indicated by the arrow J illustrated in FIG. 2. Before removing the unsealing member 254, the user needs to complete the separation process of the photosensitive unit 8 and the developing unit 9.

Figure 13A:
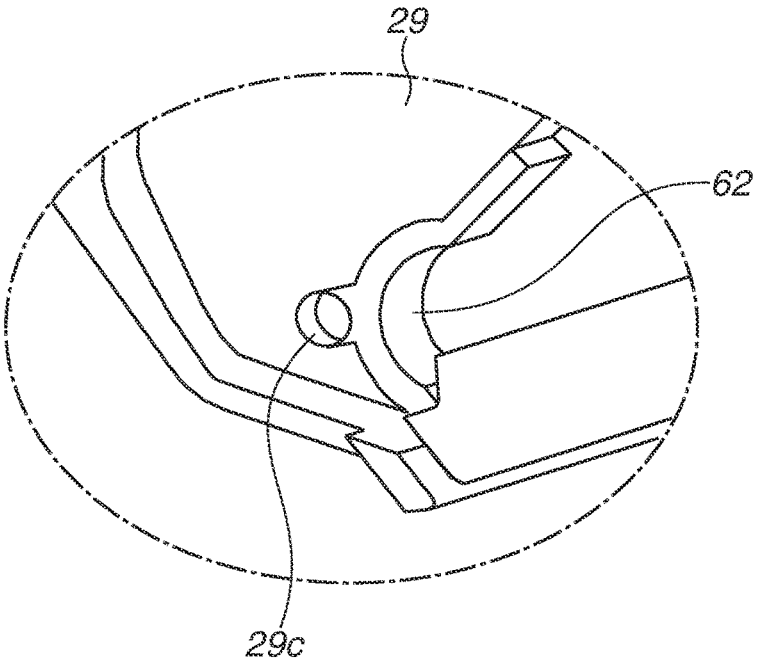
FIGS. 13A and 13B are perspective views illustrating a process for separating a supply roller from the frame member.
Figure 13B:
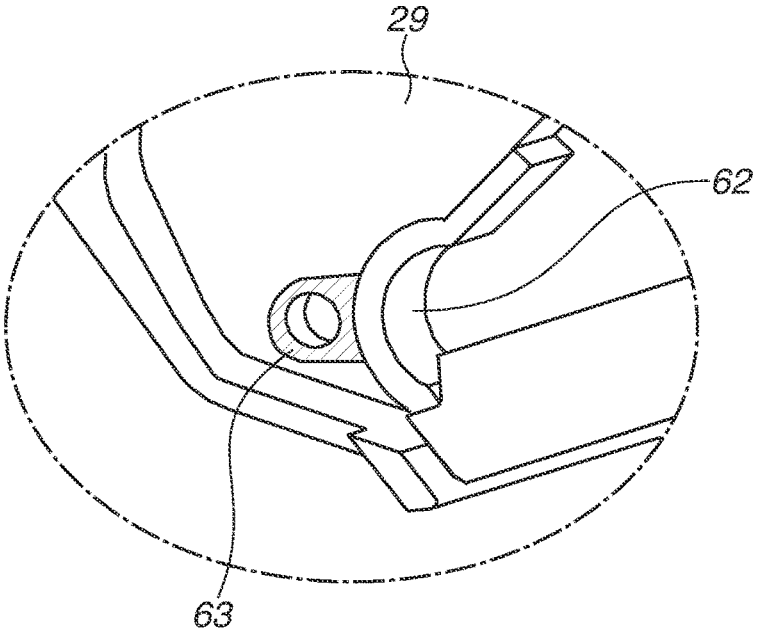

FIGS. 13A and 13B are perspective views illustrating a process for separating the supply roller 61 from the frame member 29. As illustrated in FIG. 13A, when the shaft of the supply roller 61 is fitted into the hole 29*c* of the frame member 29 and the gap between the shaft of the supply roller 61 and the frame member 29 is sealed by the end seals 62, the end seals 62 are taken out and then the supply roller 61 is separated from the frame member 29.

Although the user may perform the removing process for both of the respective end seals 62 on the drive side and the non-drive side, the method is not limited thereto. For example, after performing the removing process only for the end seal 62 on the non-drive side, the user may pull out the supply roller 61 toward the non-drive side to separate it from the frame member 29.

Although, in the above descriptions, the supply roller 61 is fitted into the frame member 29, the supply roller 61 may be fixed to the frame member 29 via a fixing member 63 of the supply roller 61 (refer to FIG. 13B). In this case, the fixing member 63 of the supply roller 61 is separated from the frame member 29. Then, the supply roller 61 is separated from the frame member 29. Although the user may perform the process for separating the fixing member 63 of the supply roller 61 from the frame member 29 on both of the non-drive side and the drive side, the user may perform the removing process only on either one of the non-drive side and the drive side.

For example, when the removing process of the fixing member 63 of the supply roller 61 is performed only on the non-drive side, the supply roller 61 can be separated from the frame member 29 by pulling out the supply roller 61 toward the non-drive side.

[Sealing Member and Unsealing Member Separation Process]

Figure 14A:
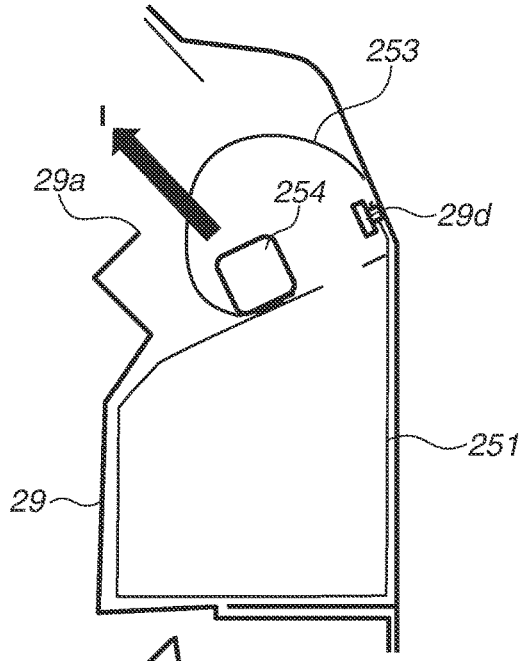
FIG. 14A is a sectional view illustrating a process for separating a sealing member and the unsealing member from the frame member.
Figure 14B:
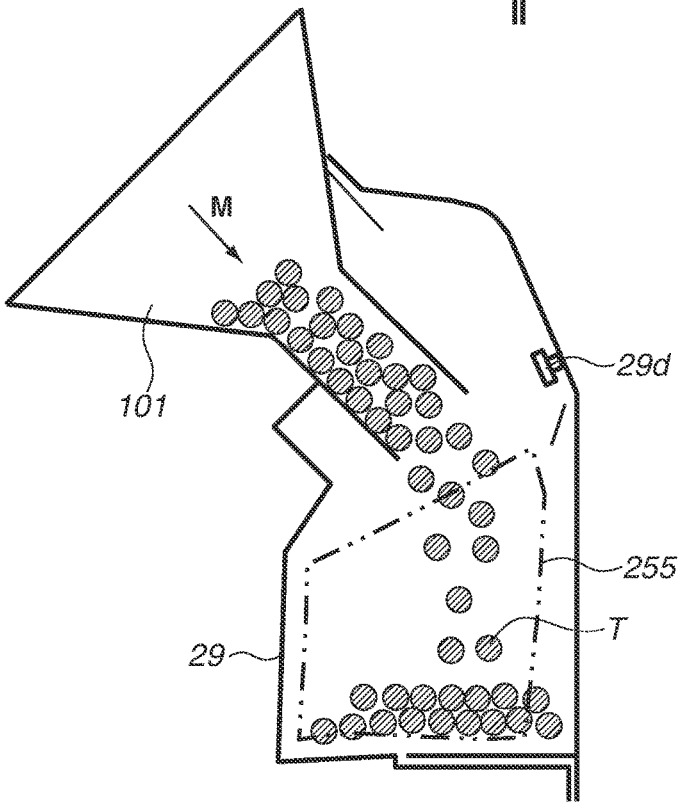
FIG. 14B is a sectional view illustrating a process for refilling the developer into the flexible container inside the frame member.

FIG. 14A is a sectional view illustrating a process for separating the sealing member 253 and the unsealing member 254 from the frame member 29. FIG. 14B is a sectional view illustrating a process for refilling the developer into the flexible container 251 inside the frame member 29. The developing unit 9 includes the sealing member 253 for sealing the openings 251*h* and exposing the openings 251*h* when being moved, and the unsealing member 254, to which the sealing member 253 is attached, and which moves to unseal the openings 251*h*.

Since the sealing member 253 and the unsealing member 254 are engaged with each other, they can be simultaneously separated from the frame member 29. First of all, the user removes the unsealing gear 67 (refer to FIG. 12A) fitted in a hole 254*b* of the unsealing member 254, from the outside of the surface on the drive side of the frame member 29.

On the non-drive side, the shaft 254*a* of the unsealing member 254 is fitted in the hole 29*c* formed inside the frame member 29. In a state where the unsealing gear 67 on the drive side has been taken out from the unsealing member 254, the shaft 254*a* can be easily pulled out from the hole 29*c*. As illustrated in FIG. 14A, the unsealing member 254 is then moved through the opening 29*a* in the direction indicated by an arrow I, so that the unsealing member 254 is separated from the frame member 29. This separation process is a process for separating the sealing member 253 and the unsealing member 254 from the frame member 29 before the taking-out process and the refilling process.

Then, the unsealing gear 67 once removed is reattached to the frame member 29. Although the unsealing gear 67 is reattached to the frame member 29, the hole of the frame member 29 in which the unsealing gear 67 had been inserted may be blocked by a sealing member. In the above-described separation process, the sealing member 253 and the unsealing member 254 are separated from the frame member 29.

[Developer Refilling Process]

FIG. 14B is a sectional view illustrating a process for refilling the developer into the frame member 29. A process for refilling the developer will be described below with reference to FIG. 14B. In the developer refilling process, the funnel 101 injects the developer T in the direction indicated by the arrow M. The injected developer T falls into the frame member 29 from the tip portion of the funnel 101, and is accumulated in a refilling space 255 inside the frame member 29. In this manner, the developer T is filled into the frame member 29.

According to the above-described method, since the unsealing member 254 is separated from the frame member 29, the injection of the developer T is not disturbed by the unsealing member 254. Further, the injection of the developer T is not blocked by the sealing member 253. Therefore, the developer T can be efficiently injected. Using a fixed-rate feeding device having an auger instead of the funnel 101 enables efficient injection of the developer T into the frame member 29.

Although, in the present embodiment, air is used in the compression process to efficiently compress the flexible container 251, the method is not limited thereto. More specifically, in the developer refilling process, the developer T injected from the funnel 101 may be used to compress the flexible container 251 and the developer T may be filled into the frame member 29.

[Developing Unit Reassembling Process] and [Unit Combining Process]

Subsequently, the user performs a reassembling process of the developing unit 9 and a unit combining process of the photosensitive unit 8 and the developing unit 9. Upon completion of the above-described procedure, the assembling process of the cartridge P is completed as illustrated in FIG. 2. The above-described remanufacturing method of the cartridge P enables achievement of a simplified remanufacturing method of the cartridge P.

Seventh Embodiment

Figure 16A:
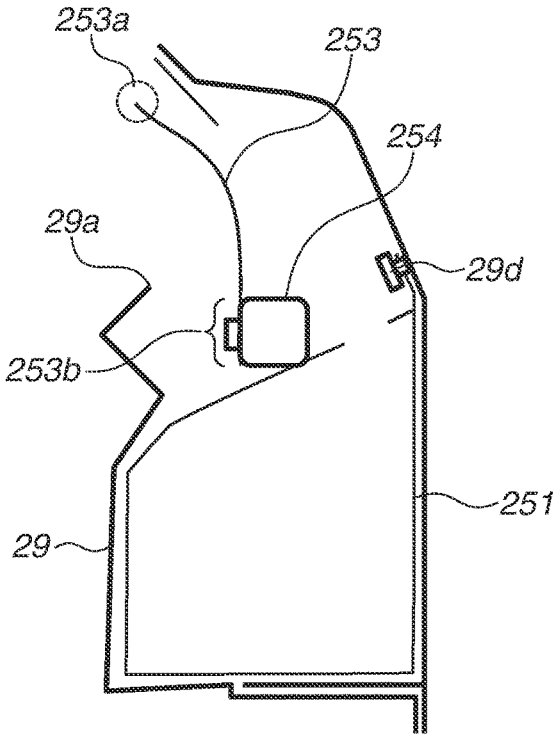
FIG. 16A is a sectional view illustrating the frame member after the supply roller is removed according to a seventh embodiment.
Figure 16B:
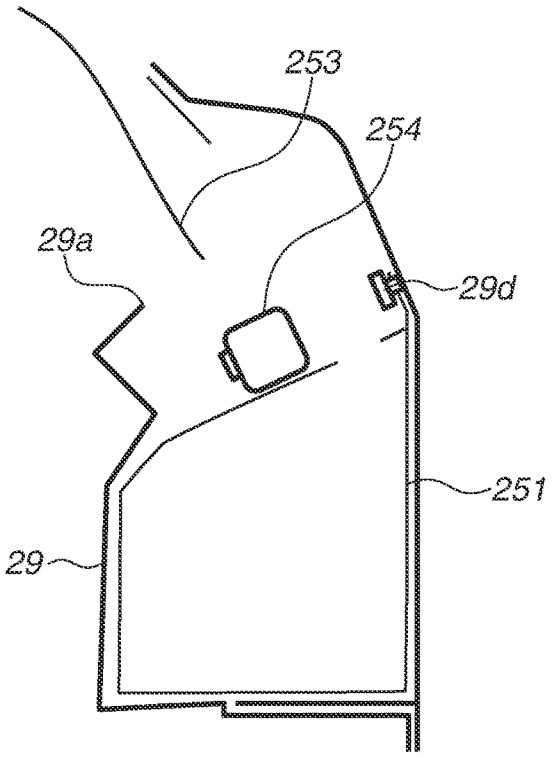
FIG. 16B is a sectional view illustrating a process for separating the sealing member from the unsealing member and taking out the sealing member from the frame member according to the seventh embodiment.

FIG. 16A is a sectional view illustrating the frame member 29 after the supply roller 61 is removed according to the seventh embodiment. FIG. 16B is a sectional view illustrating a process for separating the sealing member 253 from the unsealing member 254 and then taken out the sealing member 253 from the frame member 29 according to the seventh embodiment. The sealing member 253 is engaged with the unsealing member 254, for example, through thermal welding, ultrasonic welding, or adhesion.

The unsealing member 254 is manually rotated so that a free end 253*a* of the sealing member 253 is positioned at the opening 29*a*. A portion of the sealing member 253 excluding an engaged portion 253*b* engaged with the unsealing member 254 is cut off in the longitudinal direction using a cutter. As illustrated in FIG. 16B, the sealing member 253 is separated from the frame member 29 through the opening 29*a*.

In other words, the remanufacturing method includes a separation process for partly separating the sealing member 253 from the frame member 29. In the separation process, the sealing member 253 is cut off at a "portion other than the engaged portion" engaged with the unsealing member 254 (including a case of a separation cutoff line 253*c* (described below) illustrated in FIGS. 17A and 17B) and then separated from the frame member 29.

In the present embodiment, the sealing member 253 excluding the engaged portion 253*b* engaged with the unsealing member 254 is cut off. However, in the case of welding or adhesion in which the engaged portion 253*b* and the unsealing member 254 are easy to be detached, the sealing member 253 may be detached including the engaged portion 253*b*. In this separation process, the engaged portion 253*b* engaged with the unsealing member 254 is disengaged, and the sealing member 253 is thereby separated from the frame member 29.

Figure 17A:
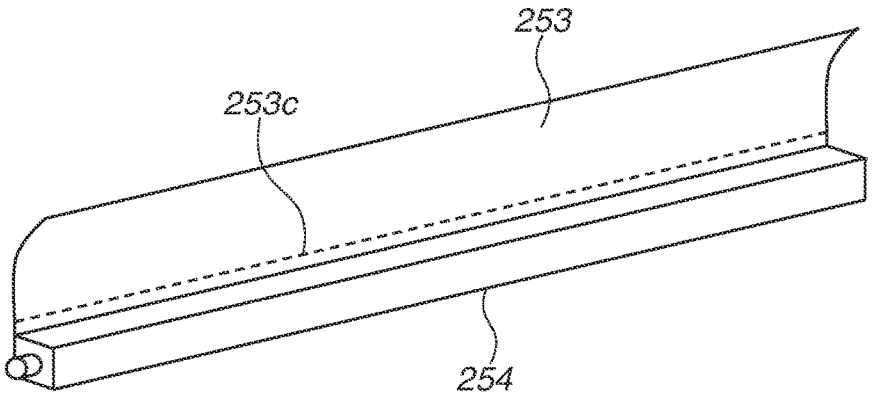
FIG. 17A is a perspective view illustrating a state before the sealing member is separated from the unsealing member.
Figure 17B:
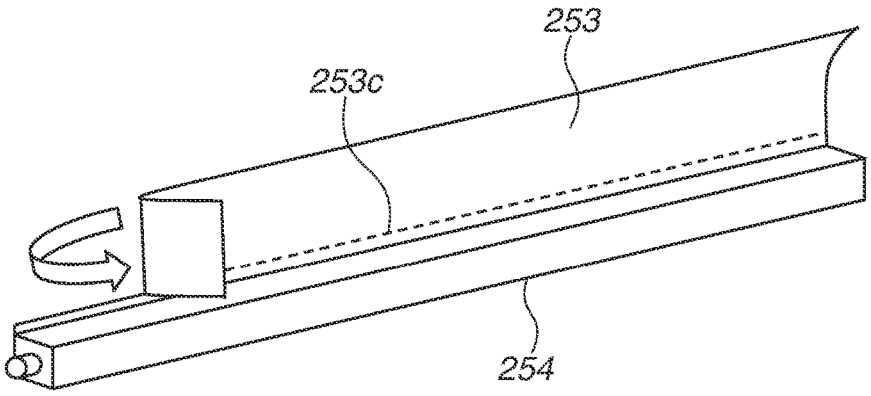
FIG. 17B is a perspective view illustrating a process for separating the sealing member from the unsealing member.

FIG. 17A is a perspective view illustrating a state before the sealing member 253 is separated from the unsealing member 254. FIG. 17B is a perspective view illustrating a process for separating the sealing member 253 from the unsealing member 254. As illustrated in FIG. 17B, the separation cutoff line 253*c* to be used for cutting the sealing member 253 from the unsealing member 254 is formed on the sealing member 253, in parallel with the axis direction of the unsealing member 254, making it easier to separate the sealing member 253.

[Flexible Container Separation Process]

Figure 18A:
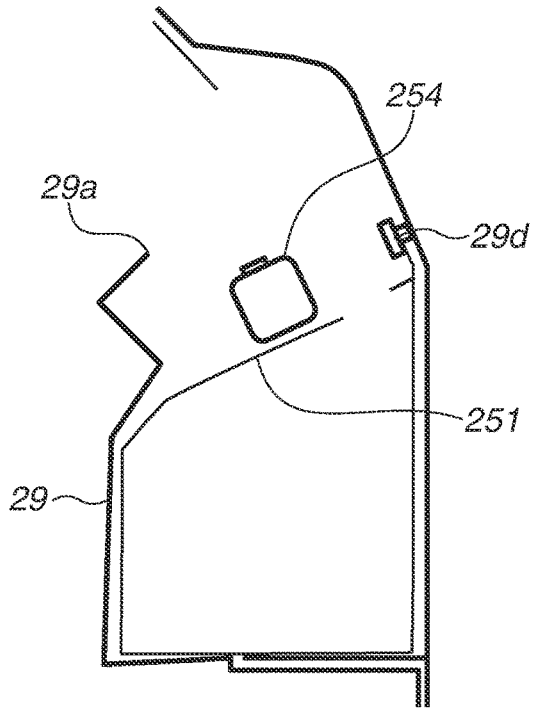
FIG. 18A is a sectional view illustrating a state after the sealing member is separated from the frame member.

FIG. 18A is a sectional view illustrating a state after the sealing member 253 is separated from the frame member 29. A separation process for separating the flexible container 251 from the frame member 29 will be described below with reference to FIG. 18A. Since the flexible container 251 is fixed to the frame member 29 by the projection 29*d* of the frame member 29, the projection 29*d* is first unfixed. In the present embodiment, as a method for fixing the fixing portion 29*b*, a boss of the frame member 29 is put through a hole on the flexible container 251 and then the boss is crushed through ultrasonic swaging.

Figure 18B:
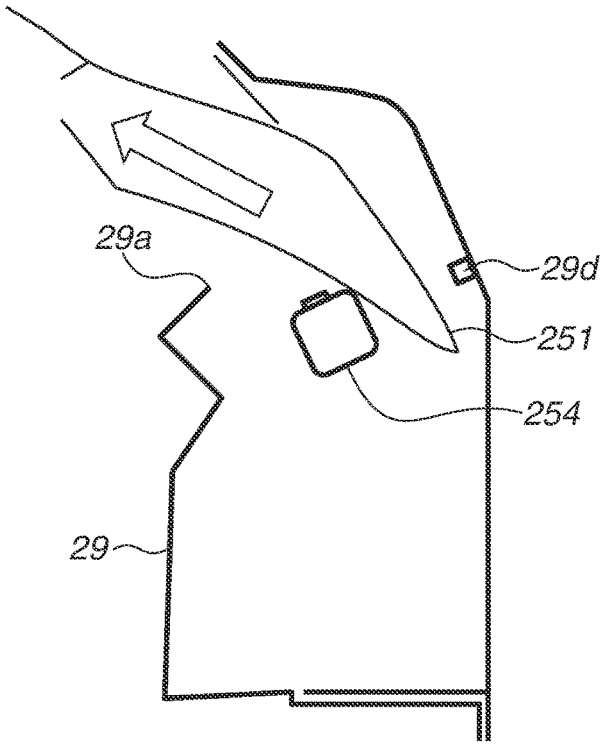
FIG. 18B is a sectional view illustrating a process for separating the flexible container from the frame member.

FIG. 18B is a sectional view illustrating a process for separating the flexible container 251 from the frame member 29. As illustrated in FIG. 18B, when the above-described boss is cut off, the flexible container 251 can be taken out from the frame member 29.

Although, in the present embodiment, the projection 29*d* is unfixed and then the flexible container 251 is taken out from the frame member 29, the flexible container 251 may be detached from the frame member 29 by cutting off a portion other than the projection 29*d*. After the flexible container 251 is detached from the frame member 29 in this way, the flexible container 251 is pulled out and separated through the opening 29*a*. According to the above-described method, in the developer refilling process, the developer T can be efficiently injected into the frame member 29 without the opening 29*a* being blocked by the sealing member 253.

Although, in the seventh embodiment, only the sealing member 253 is separated from the unsealing member 254 and the flexible container 251 is thereby separated from the frame member 29, the method is not limited thereto. More specifically, similar to the sixth embodiment, the sealing member 253 may be separated from the frame member 29 together with the unsealing member 254 and the flexible container 251 may be thereby separated from the frame member 29 in the method according to the seventh embodiment.

Although, in the sixth embodiment, the sealing member 253 is separated from the frame member 29 together with the unsealing member 254, the method is not limited thereto. More specifically, similar to the seventh embodiment, only the sealing member 253 may be separated from the unsealing member 254 and the flexible container 251 may be thereby separated from the frame member 29 in the method according to the sixth embodiment.

According to the configurations of the first to the seventh embodiments, the remanufacturing method of the developing unit 9 is simplified when compared with the conventional technique. The configurations or processes according to the first to the seventh embodiments can be suitably combined.

Although, in the first to the seventh embodiments, the description has been given of the cartridge P including the developing unit 9 and the photosensitive unit 8, the configuration is not limited thereto as long as the cartridge P includes the developing unit 9. In other words, the first to the seventh embodiments are also applicable to a developing device, a cartridge, and an image forming apparatus as long as these include the developing unit 9.

According to an embodiment of the present invention, it is possible to provide a novel remanufacturing method of a developer accommodating unit.

While the present invention has been described with reference to embodiments, it is to be understood that the invention is not limited to the disclosed embodiments. The scope of the following claims is to be accorded the broadest interpretation so as to encompass all such modifications and equivalent structures and functions.

What is claimed is:

1. A remanufacturing method of a developing device being detachably mountable to an image forming apparatus and including a frame member and a developer bearing member configured to develop an electrostatic image formed on an image bearing member, the remanufacturing method comprising:

taking out at least part of a flexible container from an inside of the frame member, wherein the flexible container is provided with an opening for discharging developer into the frame member; and refilling developer into the frame member.

2. The remanufacturing method according to claim 1, wherein the flexible container is provided with a plurality of the openings for discharging developer into the frame member.

3. The remanufacturing method according to claim 1, wherein the flexible container includes an accommodating portion configured to accommodate developer and a fixed portion configured to be fixed to the frame member, and wherein the fixed portion includes a hole different from the opening.

4. The remanufacturing method according to claim 3, wherein the frame member includes a projection configured to be insertable into the hole, and wherein the remanufacturing method further comprises separating the fixed portion from the projection.

5. The remanufacturing method according to claim 4, wherein a circumference of the hole is made of an elastic material, and wherein the projection includes a large size portion with a size larger than a size of the hole and a small size portion with a size equal to or smaller than a size of the hole, the large-size portion being insertable to the hole.

6. The remanufacturing method according to claim 3, further comprising:

cutting off at least part of a projection of the frame member, the projection configured to being insertable into the hole, and separating the flexible container from the frame member.

7. The remanufacturing method according to claim 6, wherein the remanufacturing method further comprises cutting off a large size portion of the projection with a size larger than a size of the hole.

8. The remanufacturing method according to claim 3, wherein the frame member includes a projection configured to be insertable into the hole, and wherein the remanufacturing method further comprises cutting off at least part of the flexible container.

9. The remanufacturing method according to claim 8, wherein the remanufacturing method further comprises cutting off the fixed portion between the accommodating portion and the hole.

10. The remanufacturing method according to claim 3, wherein the developing device includes a sealing member configured to seal the opening and to expose the opening when moved, and an unsealing member, to which the sealing member is attached, and operable to move to unseal the opening, and wherein the unsealing member is located inside the frame member.

11. The remanufacturing method according to claim 3, wherein the hole of the flexible container is disposed on a side of an opening of the frame member rather than on a side of the accommodating portion of the flexible container.

12. A remanufacturing method of a cartridge including an image bearing member and a developing device remanufactured by the remanufacturing method according to claim 1, the remanufacturing method of the cartridge comprising:

combining the image bearing member with the developing device.

13. A remanufacturing method of an image forming apparatus including an image bearing member and a developing device remanufactured by the remanufacturing method according to claim 1, the remanufacturing method of the cartridge comprising:

combining the image bearing member with the developing device.

14. A remanufacturing method of a developing device being detachably mountable to an image forming apparatus and including a frame member and a developer bearing member configured to develop an electrostatic image formed on an image bearing member, the remanufacturing method comprising:

taking out at least part of a flexible container from an inside of the frame member, wherein the flexible container is provided with an opening for discharging developer into the frame member; and refilling developer into the frame member, so that refilled developer is accumulated inside the frame member while the refilled developer is filled from outside of the frame member to inside of the frame member.

15. The remanufacturing method according to claim 14, wherein the flexible container is provided with a plurality of the openings for discharging developer into the frame member.

16. The remanufacturing method according to claim 14, wherein the flexible container includes an accommodating portion configured to accommodate developer and a fixed portion configured to be fixed to the frame member, and wherein the fixed portion includes a hole different from the opening.

17. The remanufacturing method according to claim 16, wherein the frame member includes a projection configured to be insertable into the hole, and wherein the remanufacturing method further comprises separating the fixed portion from the projection.

18. The remanufacturing method according to claim 17, wherein a circumference of the hole is made of an elastic material, and wherein the projection includes a large size portion with a size larger than a size of the hole and a small size portion with a size equal to or smaller than a size of the hole, the large-size portion being insertable to the hole.

19. The remanufacturing method according to claim 16, further comprising:

cutting off at least part of a projection of the frame member, the projection configured to being insertable into the hole, and P1 separating the flexible container from the frame member.

20. The remanufacturing method according to claim 19, wherein the remanufacturing method further comprises cutting off a large size portion of the projection with a size larger than a size of the hole.

21. The remanufacturing method according to claim 16, wherein the frame member includes a projection configured to be insertable into the hole, and wherein the remanufacturing method further comprises cutting off at least part of the flexible container.

22. The remanufacturing method according to claim 21, wherein the remanufacturing method further comprises cutting off the fixed portion between the accommodating portion and the hole.

23. The remanufacturing method according to claim 16, wherein the developing device includes a sealing member configured to seal the opening and to expose the opening when moved, and an unsealing member, to which the sealing member is attached, and operable to move to unseal the opening, and wherein the unsealing member is located inside the frame member.

24. The remanufacturing method according to claim 16, wherein the hole of the flexible container is disposed on a side of an opening of the frame member rather than on a side of the accommodating portion of the flexible container.

25. A remanufacturing method of a cartridge including an image bearing member and a developing device remanufactured by the remanufacturing method according to claim 14, the remanufacturing method of the cartridge comprising:

combining the image bearing member with the developing device.

26. A remanufacturing method of a developing device being detachably mountable to an image forming apparatus and including a frame member and a developer bearing member configured to develop an electrostatic image formed on an image bearing member, the remanufacturing method comprising:

taking out the developer bearing member from the frame member;

taking out at least part of a flexible container from an inside of the frame member, wherein the flexible container is provided with an opening for discharging developer into the frame member; and refilling developer into the frame member through a frame member opening that is made exposed by the developer bearing member being removed.

27. The remanufacturing method according to claim 26, wherein the flexible container is provided with a plurality of the openings for discharging developer into the frame member.

28. The remanufacturing method according to claim 26, wherein the flexible container includes an accommodating portion configured to accommodate developer and a fixed portion configured to be fixed to the frame member, and wherein the fixed portion includes a hole different from the opening.

29. The remanufacturing method according to claim 28, wherein the frame member includes a projection configured to be insertable into the hole, and wherein the remanufacturing method further comprises separating the fixed portion from the projection.

30. The remanufacturing method according to claim 29, wherein a circumference of the hole is made of an elastic material, and wherein the projection includes a large size portion with a size larger than a size of the hole and a small size portion with a size equal to or smaller than a size of the hole, the large-size portion being insertable to the hole.

31. The remanufacturing method according to claim 28, further comprising:

cutting off at least part of a projection of the frame member, the projection configured to being insertable into the hole, and separating the flexible container from the frame member.

32. The remanufacturing method according to claim 31, wherein the remanufacturing method further comprises cutting off a large size portion of the projection with a size larger than a size of the hole.

33. The remanufacturing method according to claim 28, wherein the frame member includes a projection configured to be insertable into the hole, and wherein the remanufacturing method further comprises cutting off at least part of the flexible container.

34. The remanufacturing method according to claim 33, wherein the remanufacturing method further comprises cutting off the fixed portion between the accommodating portion and the hole.

35. The remanufacturing method according to claim 28, wherein the developing device includes a sealing member configured to seal the opening and to expose the opening when moved, and an unsealing member, to which the sealing member is attached, and operable to move to unseal the opening, and wherein the unsealing member is located inside the frame member.

36. The remanufacturing method according to claim 28, wherein the hole of the flexible container is disposed on a side of an opening of the frame member rather than on a side of the accommodating portion of the flexible container.

37. A remanufacturing method of a cartridge including an image bearing member and a developing device remanufactured by the remanufacturing method according to claim 26, the remanufacturing method of the cartridge comprising:

combining the image bearing member with the developing device.

38. A remanufacturing method of an image forming apparatus including an image bearing member and a developing device remanufactured by the remanufacturing method according to claim 26, the remanufacturing method of the cartridge comprising:

combining the image bearing member with the developing device.

* * * * *